US005127357A

United States Patent [19]

Viskovich

[11] Patent Number: 5,127,357

[45] Date of Patent: Jul. 7, 1992

[54] GARAGE PARKING GUIDE

[76] Inventor: Bert J. Viskovich, 10385 Rivercrest Ct., Cupertino, Calif. 95014

[21] Appl. No.: 774,517

[22] Filed: Oct. 8, 1991

[51] Int. Cl.[5] ..... G08B 5/00; G02B 5/08; B60Q 9/00

[52] U.S. Cl. ..... 116/28 R; 116/202; 359/847

[58] Field of Search ..... 116/28 R, 202; 33/286; 359/527, 846, 847, 848, 849; 340/435, 932.2

[56] References Cited

U.S. PATENT DOCUMENTS

| | | | |
|---|---|---|---|
| 1,910,119 | 5/1933 | Moats | 359/847 |
| 1,981,188 | 11/1934 | Pavitt | 116/28 R |
| 2,693,044 | 11/1954 | Roemisch | 40/479 |
| 2,834,315 | 5/1958 | Simpson | 116/67 R |
| 2,854,942 | 10/1958 | Ross | 116/28 R |
| 3,121,416 | 2/1964 | Gizdich | 116/28 R |
| 3,219,972 | 11/1965 | Williams | 116/28 R |
| 3,261,321 | 7/1966 | Mandl | 116/28 R |
| 3,610,738 | 10/1971 | Bochmann | 359/847 |
| 3,621,807 | 11/1971 | Kang | 116/28 R |
| 3,793,981 | 2/1974 | Sparks | 116/28 R |
| 3,817,203 | 6/1974 | Brauer | 116/28 R |
| 3,844,050 | 10/1974 | Lynn | 33/264 |
| 3,858,966 | 1/1975 | Lowell, Jr. | 116/28 R X |
| 3,893,068 | 7/1975 | Tucker, Jr. | 33/286 X |
| 3,977,354 | 8/1976 | Mazurek | 116/28 R |
| 4,036,165 | 7/1977 | Wood | 116/28 R |
| 4,101,868 | 7/1978 | Bubnich et al. | 116/28 R X |
| 4,280,753 | 7/1981 | Nebauer | 359/847 X |
| 4,612,871 | 9/1986 | Takao | 116/202 |
| 4,811,173 | 3/1989 | Johnson | 116/28 R X |
| 4,813,758 | 3/1989 | Sanders | 116/28 R X |

FOREIGN PATENT DOCUMENTS

| | | | |
|---|---|---|---|
| 0556266 | 2/1957 | Italy | 116/28 R |

*Primary Examiner*—William A. Cuchlinski, Jr.
*Assistant Examiner*—W. Morris Worth

[57] ABSTRACT

A garage parking guide to assist a driver to park very conveniently in the same desired location of an enclosure, such as, a garage. This guide consists of an adjustable mirror and housing affixed adjacent to the garage door opening for the purpose of reflecting the vehicle's brake lights and/or view of rear bumper to the driver via the vehicle's side view mirror. The guide, properly positioned, will direct a visual image, to the driver, indicating the vehicle's relative position to the garage opening. As the vehicle enters the garage, the brake lights, will reach a predetermined alignment with that of the parking guide, so as to transmit the glow of said brake lights to the driver signifying that the vehicle has reached the final predetermined position. The vehicle guide will function with any vehicle and/or driver, once properly mounted, for any space equipped with a parking guide. The guide is capable of providing three images to the driver: normal for most occasions, magnified if driver wishes a larger brake light image, and wide angle for use when different with varying heights of brake lights from the floor use the same parking space. One parking guide must be used for each parking space. For example, a two car garage would require two parking guides; one for each side of the garage.

7 Claims, 1 Drawing Sheet

GARAGE PARKING GUIDE

FIELD OF THE INVENTION

This invention generally relates to garage parking guides, more particularly to providing a view of the rear of the vehicle for the purpose of guiding the driver to a precise parking location in an enclosure, such as a garage.

BACKGROUND OF THE INVENTION

It is widely known that positioning a vehicle in an enclosed environment, such as a garage, requires care and precision. Parking a vehicle in a confined space requires, but is not limited to, the following conditions:

1) Vehicle must be parked sufficiently inside the garage to allow clearance for the garage door to close. The clearance should be minimal.

2) Vehicle should not be parked too far forward inside the garage so as to take up usable garage space which may be used for storage, a work bench, tools, and/or equipment normally operated in the garage.

3) Driver should allow needed space for ingress and egress around the vehicle.

4) Driver must avoid hitting objects or the back wall of the garage that may lead to damage of structure, equipment and/or vehicle.

To accomplish the above, a guide is required to provide the driver with a visual signal to let the driver know when he or she has reached the proper location in which to park. Therefore, a garage parking guide can assure the driver precise parking each and every time a vehicle is parked in the garage. The guide should be universal so that it will work on any vehicle or for any driver of the vehicle.

There has been previous attempts to provide a garage parking guide. However, each has required precise installation and adjustment for a particular vehicle, and/or driver. More particularly, Saunders, U.S. Pat. No. 4813758 issued Mar. 21, 1989 requires the guide to be precisely affixed in a location dictated by the automobile, and precisely adjusted for one particular driver. It further loses flexibility as to the use of the area in front of the vehicle where the device must be affixed. Other patents involve physical levers, electrical connections and hanging devices that activate visual and/or audible signals. Physical signal producing devices: interfere with use of garage space; are unsightly; require maintenance; require repairs and adjustment when lever is bent or broken due to damage caused by vehicle; and audible signals impact household and the neighborhood.

Other past inventions conforming to the physical levers and/or indicator are: Wood U.S. Pat. No. 4036165 issued July 19, 1977 uses a lever to activate audible and visual signal when vehicle moves to its proper location; Bubrich U.S. Pat. No. 4101868 issued June 18, 1978 uses a lever housing indicator which is visible when lever is moved by vehicle to its proper location and makes contact with a transparent sheet material; Mazurek U.S. Pat. No. 3977354 issued Aug. 31, 1976 uses lever to indicate proper position; Lynn U.S. Pat. No. 3844050 issued Oct. 29, 1974; and Brauer U.S. Pat. No. 3817203 issued June 18, 1974 uses a hanging ball device that, when the approaching vehicle's windshield makes contact with said ball, the vehicle has reached the proper position.

Furthermore, earlier guides are disclosed in: Lowell Jr. U.S. Pat. No. 3858966; Sparks U.S. Pat. No. 3793981; Kang U.S. Pat. No. 3621807; Mandi U.S. Pat. No. 3261321; Williams U.S. Pat. No. 3219972; Ross U.S. Pat. No. 2854942; Roemisch U.S. Pat. No. 2693044; Simpson U.S. Pat. No. 2834315; and Pavett U.S. Pat. No. 1981188.

The above devices failed to achieve wide-spread commercial acceptance because although there have been several attempts to provide a parking guide, there has not been one that operates with the rear of the vehicle; is universal, and that will work with any vehicle or driver. It is extremely dependable with no moving parts, and is not dependent on precise adjustment. It is small and obscure, and it may be located in an unusable space selected by the user. It is not dictated by precise placement due to the automobile's travel path. It is simple to construct, attach and use. Is able to show the driver the vehicle's relationship to the door opening and clearance needed to close the garage door. The guide is capable of providing three (3) different views altering image size to the driver by providing normal view, wide view and narrow view. The present invention, therefore, overcomes deficiencies of the past inventions and provides a unique and simple method of providing a garage parking guide.

SUMMARY OF INVENTION

Accordingly, the present invention objectives are achieved by providing a garage parking guide comprised of simple optics requiring no moving parts during the operation. It directs the brightness of the brake lights of an automobile to the view of the driver via the vehicle's side view mirror. Once the brake lights are in juxtaposition with the mirror, the light rays from the brake light transmits a signal to the driver that the automobile has reached the desired parking location and the driver can stop the vehicle.

In a particular embodiment described by way of example, the parking guide is mounted on the front wall of the garage adjacent to the opening of the garage door and at a height approximately the same level at which vehicle tail lights are measured from the ground level. An exact location is selected by the user so as not to interfere with the operation or use of space.

The device is comprised of two components: 1) a plastic bracket that is used to attach the device to the supporting surface and; 2) a reflective plastic material (a mirror) which is rotatable about a vertical axis and its shape modified to flat, convex, or concave.

Once attached, the mirror portion of the device must be rotted so as to form an angle that will transmit light from the brake light portion of the vehicle to the vehicle's side view mirror. Once adjusted, this configuration will function for any vehicle parked in the space. The user, further, has additional options of views received from the device and more particularly described below:

1) Standard view—provides the view of brake lights and rear of vehicle at a normal size image.

2) Narrow view—provides a magnified or enlarged image of the tail light, but less view of other portion of rear of the automobile.

3) Wide angle view—provides smaller image of object, but shows a larger vertical view of the rear, which, is ideal if more than one vehicle varying in tail light heights, is used.

While the drier is positioning his or her vehicle in the parking space (garage), driver can visually see the progress of vehicle movement by the use of the side view mirror. The side of the car will be viewed until the rear end approaches the view of the device, at which time a bright red glow from the brake light will appear in the side view mirror signaling that the vehicle is at the predetermined location. This location signifies that the vehicles rear bumper has cleared the area needed to close the garage door.

During night or normal daylight conditions, the brake lights are sufficiently bright to provide visual images to the driver. When extreme sunlight is directed on the brake light, the brake light lens itself will constitute the signal.

These and other features and advantages will be apparent from the detailed description and claims to follow when read in conjunction with the accompanying drawing herein:

BRIEF DESCRIPTION OF THE DRAWING

FIG. 2A) front view and FIG. 2B) top view; FIG. 3A) normal shape providing normal view and image FIG. 3B) concave shape resulting in a narrow view providing magnified image of object, FIG. 3C) convex shape resulting in a wide view providing smaller image of object.

DETAILED DESCRIPTION

Figure 1:
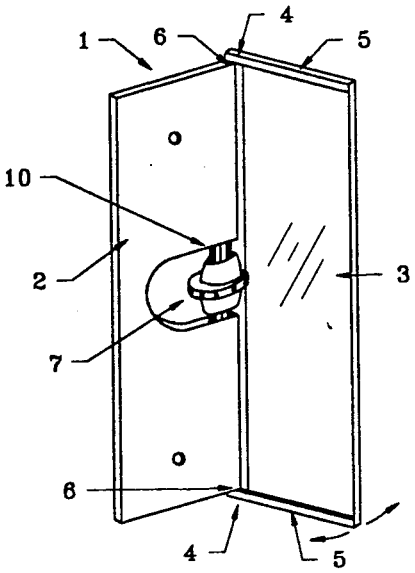
FIG. 1 is a perspective view of a vehicle parking guide device embodying the present invention.
Figure 4:
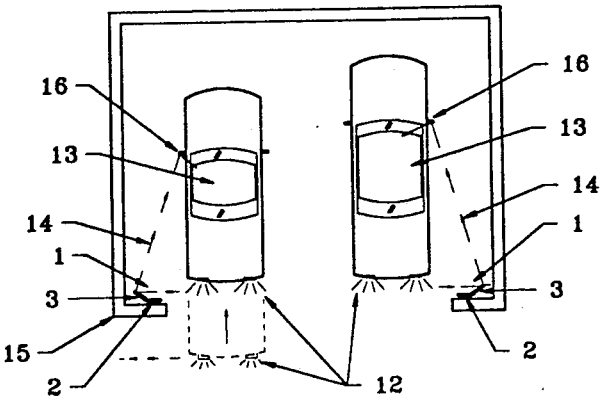
FIG. 4. Plan view showing typical use of device for both left and right side of garage in a two car garage arrangement.

Referring to FIG. 1 of the drawing, the vehicle parking guide 1 is comprised of two major components, each being approximately 12 inches high by approximately 2 inches wide. A mounting bracket 2 to be affixed to a supporting surface as shown in FIG. 4, and a optical plate being a plastic mirror 3. These two components are attached to one another by the two round posts 4 being an integral part of mirror arm 5 used to hold mirror 3 in place, inserted in a hexagonal hole 6, an integral part of bracket 2; thereby, allowing mirror 3 to rotate about the vertical axis provided by posts 4. The combination of inserting round post 4 into hexagonal hole 6 is to provide the necessary rotating resistance so when mirror 3 is rotated about bracket 2 to the desired position it will remain in place without further adjustment. The mirror 3 is the optical surface that transmits the image of the brake light rays to the driver as shown in FIG. 4.

Figure 2A:
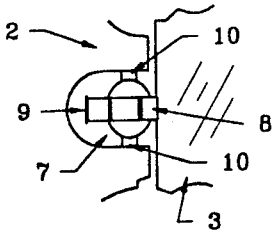
FIGS. 2A and 2B illustrates the cam in two (2) views.
Figure 2B:
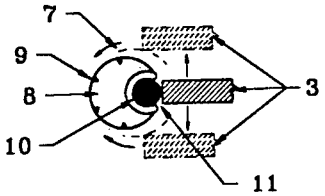
Figure 3A:
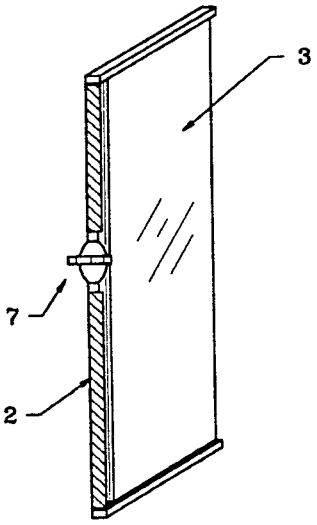
FIGS. 3A, 3B and 3C is three (3) different perspectives each illustrating a different vertical shape of the mirror.
Figure 3B:
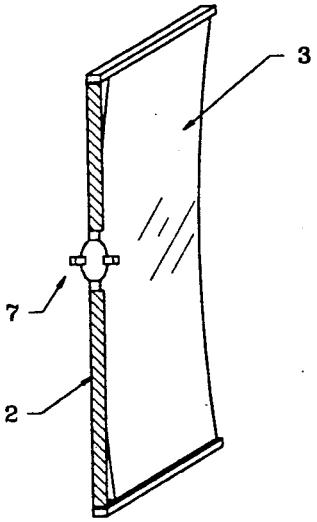
Figure 3C:
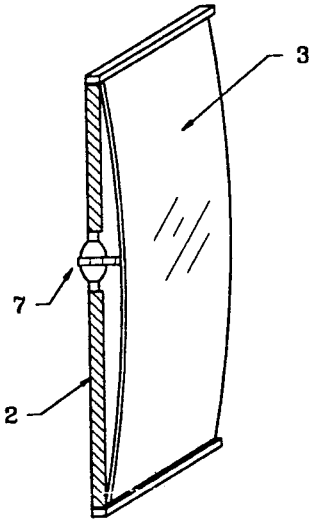

FIG. 2A is the front view of cam 7 used to change the shape of the mirror 3 as shown in FIGS. 3A, 3B and 3C. The image control cam 7 comprises of an eccentric ring 8 with notches 9 acting as stops for mirror 3 to rest upon, when mirror 3 is deformed into several convex and concave shapes, for the purpose of providing various images. The cam 7 rotates about a post 10, which is an integral part of bracket 2. FIG. 2B is a top view showing cam 7 as it relates to mirror 3 inner edge. In this view mirror 3 is in its normal and unbent vertical position resting within wedge 11, an integral part of cam 7. As cam 7 is rotated clockwise or counterclockwise about the vertical post 10, mirror 3 vertical midpoint will be moved horizontally out of and away from wedge 11, until it rests upon one of the desired notches 9 as such is shown by the dashed lines representing the outer edge of ring 8. Corresponding to said rotation of cam 7, in either direction, the relative position of mirror 3 is also shown in dashed lines demonstrating that cam 7 when acted upon can restrict the movement of mirror 3, thereby; preventing said mirror from returning to its normal position. Said mirror will maintain said position until cam 7 is rotated to a different position yielding a different bent configuration. The eccentric ring 8 allows for various magnitudes of vertical bending of mirror 3. Placing said mirror on one of the notches 9 on the wider portion of the eccentric ring 8 requires mirror 3 to travel further horizontally, yielding greater deflection while placing said mirror on notches 9 in ring 8 narrower portion will deflect said mirror less and provide less exaggerated images and views. This movement, as described above, will be more specifically described below using FIGS. 3A, 3B and 3C. FIGS. 3A, 3B and 3C has three different views depending on the location of image control 7 described above in FIG. 2A and FIG. 2B. When the image control cam 7 is left in its normal resting position as in FIG. 2A, then the shape of the mirror 3 will be as shown in FIG. 3A in its normal shape - unbent and flat. The shape, in FIG. 3A, will provide normal view, and normal image. Bending the mirror in either direction as shown in FIGS. 3B and 3C will give different images. FIG. 3B shows the mirror retracted back at the center, forming a vertically concave shape. This is accomplished by bending the mirror 3 in combination with rotating cam 7 until mirror 3 rests upon one of the notches 9 on the eccentric ring 8. In this position, the mirror 3 will rest behind cam 7 and the image provided by mirror 3 will be magnified within a narrow view. Configuration in FIG. 3C requires essentially the same operation as described above in FIG. 3B, except the center of the mirror 3 is moved forward until it rests upon one of the notches 9 in front of cam 7 as shown in FIG. 3C. This curvature of mirror 3 shown in FIG. 3C will form a convex shape, thereby, giving a smaller image of brake light 12 but providing a wider vertical view. This view will be especially valuable if several different vehicles occupy the same parking space that may have brake lights 12 located at different heights from the ground. FIG. 3C convex shape will allow view of the vehicle's brake source from many different heights giving greatest latitude for difference in vehicle height.

FIG. 4 is a plan view describing a operation of the garage parking guide. The guide 1 is located on the front wall 15 of a typical garage. The angle of mirror 3 is positioned to receive optical images 14 from the brake light 12 to reflect same image to side view mirror 16. As the vehicle enters the garage, the brakes are applied activating the brake lights. However, the light rays are not intercepted by the parking guide 1 until the vehicle reaches the proper location. This is illustrated in FIG. 4 by the longitudinal travel path of the automobile moving into the garage from the point where the brake lights are outside the garage opening as shown in dashed lines to the point where the brake lights are inside the opening illustrated by the solid lines. Vertical placement should be close to height of vehicle brake lights 12.

When light rays 14 from the brake light 12 are visibly seen by the driver through the side view mirror 16, then, this signifies that the vehicle has reached its predetermined position in the garage.

The vehicle parking guide 1, as shown, in FIG. 1 is integrally formed of plastic, is lightweight, durable and allowed to bend. It is approximately 12 inches high and approximately 5½ inches wide, and the thickness of the plate and mirror is approximately ⅜ inches. It is simple to construct. It is easy to use. It Attaches easily to support structure by simple screws, and is located away from the travel path of the vehicle, precluding damage to the device.

I claim:

1. A vehicle parking guide for assisting a driver in parking a vehicle in a predetermined longitudinal position comprising:

a mounting bracket, adapted to be fixedly mounted relative to a supporting surface, a bendable light reflective member capable of having its shape modified to form multitude of concave and convex shapes, cam means rotatable about a vertical post and engageable with said reflective member for modifying the shape of said member; said post being an integral part of said mounting bracket, means for joining said reflective member to said mounting bracket so as to be able to rotate axially about one edge of said mounting bracket to form a multitude of angles with respect to said mounting bracket.

2. The device as set forth in claim 1, wherein said mounting bracket is disposed in juxtaposition to a garage opening and at a height from a garage floor approximately that of a vehicle's brake lights.

3. The device as set forth in claim 1, wherein said reflective member is a plastic mirror, and said joining means permits rotation of said mirror about a vertical axis relative to said mounting bracket so as to form an angle, properly aligned to receive and reflect light rays emitting from a vehicle's brake lights, and in a line of sight capable of propagating said light rays to a driver's view via a vehicle's side view mirror.

4. The device as set forth in claim 3, wherein said mirror is pivotally mounted relative to said mounting bracket, and adjustable so as to permit said driver to view said vehicle's brake lights when said vehicle is in said predetermined longitudinal position, said vehicle's brake lights being visible in said side view mirror only at a predetermined stopping point relative to garage's front opening.

5. The device as set forth in claim 1, wherein said reflective member is a plastic mirror, pivotally mounted by the joining means to said mounting bracket, said joining means including means for restraining said mirror at its longitudinal ends, while a center area of said mirror is movable from an unbent resting position, to either a convex or concave shape, said cam means having means for restricting said mirror from returning to its original unbent position, thereby, placing said mirror in a permanent mode, said cam means has an eccentric shape engageable at a peripheral edge thereof with the center area of said mirror so as to provide a multitude of mirror vertical curvature configurations.

6. The device as set forth in claim 5, wherein when said mirror is in said convex shape, relative to said mirror's vertical plane, said mirror provides a wider viewing angle, by which to receive, reflect and propagate light rays emitting from a vehicle's brake lights and said brake light image in said mirror appears smaller than normal size.

7. The device as set forth in claim 5, wherein when said mirror is in said concave shape, relative to said mirror's vertical plane, said mirror provides a narrower viewing angle, by which to receive, reflect, and propagate light rays emitting from a vehicle brake lights, and said brake light image in said mirror appears larger than normal size.

* * * * *